US005452808A

United States Patent [19]

Abramowitz

[11] Patent Number: 5,452,808

[45] Date of Patent: Sep. 26, 1995

[54] AMBULATORY PATIENT MEDICAL RECORD HOLDER

[76] Inventor: Joseph M. Abramowitz, 18 Covert St., Port Washington, N.Y. 11050

[21] Appl. No.: 223,967

[22] Filed: Apr. 6, 1994

[51] Int. Cl.[6] ..... A47F 7/00

[52] U.S. Cl. ..... 211/45; 211/128

[58] Field of Search ..... 211/45, 52, 113, 211/128, 133; 312/184

[56] References Cited

U.S. PATENT DOCUMENTS

| | | | |
|---|---|---|---|
| 1,964,223 | 6/1934 | Smith | 211/45 |
| 2,713,531 | 7/1955 | Boone . | |
| 2,955,372 | 10/1960 | Anthrop . | |
| 3,393,030 | 7/1968 | Block . | |
| 3,472,387 | 10/1969 | Olsen . | |
| 3,798,423 | 3/1974 | Mindick | 211/45 |
| 3,868,717 | 2/1975 | Cutter | 211/45 |
| 3,962,807 | 6/1976 | Pantone . | |
| 4,041,893 | 8/1977 | Mulloy . | |
| 4,865,549 | 9/1989 | Sonsteby . | |
| 4,893,745 | 1/1990 | Weber et al. . | |
| 4,921,098 | 5/1990 | Combier et al. | 211/45 |
| 4,967,928 | 11/1990 | Carter . | |
| 5,086,934 | 2/1992 | Kelly . | |

*Primary Examiner*—Alvin C. Chin-Shue
*Assistant Examiner*—Sarah L. Purol
*Attorney, Agent, or Firm*—Collard & Roe

[57] ABSTRACT

A portable patient medical record holder has a color coded system and includes an elongated box with a front side and a back side. Each of these sides has a plurality of parallel spaced slots extending substantially across the lateral distance of the front and back sides. A plurality of folders, each having a sealed bottom edge, may be fitted substantially within these slots. A plurality of pockets extend into the elongated box from the slots. Each pocket supports a folder within the slots. A substantially planar surface on the front side supports material and allows for graphic inscription thereon. Means for tracking the files includes having the same markings on the folders and on the respective elongated box.

8 Claims, 3 Drawing Sheets

AMBULATORY PATIENT MEDICAL RECORD HOLDER

BACKGROUND OF THE INVENTION

1. Field of the Invention

The present invention relates to a portable device for holding medical records of a patient.

2. The Prior Art

In the past few years there has been a dramatic shift from inpatient management to outpatient ambulatory management of patients requiring hospitalization for medical procedures. This shift has resulted from economic necessity and has been made possible by fine-tuning of various aspects of care so that patient safety is not compromised. As hospitals are forced to become more efficient, the smooth transit of patients through the ambulatory medical encounter becomes all the more crucial. The patient's hospital stay may last only three or four hours, but in that time multiple health care providers have to handle and make contributions to the patient's medical record.

Prior art medical record holders are inadequate for the task at hand, and alternatives such as single file folders and clipboards offer little more than the merits of a paper clip. Much time is wasted looking through disorganized and uncategorized papers for an elusive document. Worse yet, a sheet of paper from the record of one patient may find its way into the wrong chart, leading to the potential for grave errors with consequent patient injury and litigation.

As will become apparent from the following description, the present invention overcomes the limitations incumbent in the prior art, providing unique solutions to the real time management of the medical record in the ambulatory care setting.

Attempts have been made in the past to provide a suitable system for keeping track of the medical records of patients; and prior proposals are as follows.

The Boone U.S. Pat. No. 2,713,531 discloses a filing device which can contain multiple filing folders. More particularly, this invention discloses a cabinet which can hold a multiplicity of clip boards in slotted rows. Each clip board is then provided with a flange which contains writing describing the text contained therein.

The Anthrop U.S. Pat. No. 2,955,372 discloses a clipboard chart holder in a rack-like system. This rack system allows the storage of charts to be in a staggered manner. Each face of the rack has this storage system of staggered charts. The bottom of this rack is mounted on a lazy susan revolving platform. Each clipboard is provided with extending arms, stretched out from either side of the clipboard. These arms hold the clipboard in this rack system.

The Block U.S. Pat. No. 3,393,030 discloses a hospital chart holder file cabinet and warning signal apparatus. A series of horizontally extending manually operable shafts are rotatably mounted in the file cabinet adjacent each of the file compartments. Warning signal units are arranged in spaced relationship in the file cabinet adjacent each of the file compartments, and warning signal means are provided. These warning signal means are operable by each of the manually-operable horizontally-extending shafts for indicating the presence of a work order in a hospital chart holder in the adjacent file compartment.

The Olson U.S. Pat. No. 3,472,387 discloses a portable hospital record chart holder apparatus including a wheel bearing frame which includes means for supporting hospital record chart holders vertically. There is also provided snubber bars which hold the charts in place and keep them from clanging. This chart holder is also mounted on rollers to make it portable.

The Mulloy U.S. Pat. No. 4,041,893 discloses a chart for use in hospitals and nursing homes, indicating the procedure to be taken in the continuing care of the patient. The device consists of a flat sheet of a relatively rigid material, including two vertical slots adjacent the respective side edges thereof. The device also includes associate linear slide member indicators, a horizontal groove and linear slide member indicator, and upper and lower rotary indicators. The various linear and one rotary indicator being operable to indicate the various procedures, the other of the rotary indicators being designed to indicate the time of a particular procedure.

The Carter U.S. Pat. No. 4,967,928 discloses a medicine cart which has a means for dispensing medicines including narcotics on nurse rounds. The cart includes a CPU with memory and various input devices. In addition, the section to secure narcotics is locked, and as the nurse rounds are made, individual doses of narcotics and medicines or both are dispensed. At the end of the medication round, hard copies reflecting individual patient medications are printed, and beginning and ending narcotics inventories are compiled. Chart entries for patients are likewise printed.

The Kelly U.S. Pat. No. 5,086,934 discloses a radiographic film holder comprising a wheel- bearing support base, hanging bars supported on the base, and a continuous flexible strip. This continuous flexible strip has pockets formed across the width thereof supported by metal flat bars inserted into the pockets, mated with opposing holes in the hanging bars, and forming a series of downwardly-hanging flexible strip, film record holder slots.

The Pantone U.S. Pat. No. 3,962,807 discloses a system for identifying X-rays wherein a coded visual display is affixed to the X-ray films to enable a radiologist to identify at a glance the part of the body radiographed. In addition the visual display would disclose the particular visit during which the X-ray was taken. Written X-ray findings are affixed to the X-ray storage envelope in either a color code, a symbolic code, or a combination of both.

The Sonsteby U.S. Pat. No. 4,865,549 discloses a documentation system that includes a plurality of sections, each section dedicated to a particular body system. Each section has a plurality of peel off labels, each label providing a series of assessment steps. Each label has a distinctive color associated with a particular section, with the text also being associated in distinctive color.

The Weber U.S. Pat. No. 4,893,745 discloses a suspendible folder having a front panel and a back panel with the bottom edges and a segment of each lateral edge secured to one another. The secured segment of lateral edges is defined by two points, the first point is near the bottom edge of the front panel. The second point is spaced from the first point by about one half to two thirds the height of the back panel. At or near the second point, a circular radius is cut, provided to assist in distributing tearing forces across both the front panel and the back panel.

SUMMARY OF THE INVENTION

It is an object of the present invention to provide a portable device for holding a patient's medical records, which device also provides for quick access to vital medical information.

The medical record holder includes a rectangularly-shaped container or box, with multiple slots on both sides for insertion of various folders. Each slot is color coded and would house the corresponding color coded medical documents. In addition, each folder would be numbered to correspond to the number given on the top of the medical record holder box. This feature would allow various misplaced documents to return to their rightful medical record holders.

The box itself has a length to accommodate multiple slots spaced parallel to each other, with an additional lower space to provide support for writing. Attached to the top of the box is a handle for carrying, and a hook to hang the box from the bed rail. Additionally, this box is portable and durable, with reinforced edges so it can be reused after the patient leaves the hospital. The file folders can also be recycled.

Using a new box/slot system, a single box containing several color-coded slots on each side would hold separate color-coded file folders for each category of document. For example, a blue folder could contain the admission data, a pink folder could contain medical history and a physical exam, and a black folder could hold the x-ray reports. The folders would fit into, and correspond to, the color-coded slots, with each slot housing one folder. Typically, this box would have two to six (preferably three to five) slots located on each side of the box.

The documents, folders and box are also coded with an alphanumeric system so that a patient's records are not lost or switched between boxes. The assigned code can be located on the top of the box and on a visible portion of each file folder.

The device cain be about 2" thick and 14" long with a handle and a hook at the top for carrying or hanging from a bed rail. The use of the color coding on each file together with the box code will lessen the chance of confusion and make it quick for any of the doctors, or nurses, to locate the folder in question. Of course, the box will be reusable and will have reinforced corners and will probably be made of plastic material that is non-destructible. Therefore, when the patient is discharged, all the file information will be sent down to hospital records and the file folder and box will be recycled for the next patient.

The above objects and advantages are achieved according to the present invention, by providing a portable patient medical record holder having a color coded system comprising a box encasement with a front side and a back side each having a plurality of parallel spaced slots extending substantially across the lateral distance of both front and back sides. A plurality of folders with each folder having a sealed bottom edge, may each be fitted within one of the slots on the box. A plurality of pockets extend from the slots wherein the pockets support the folders within the box. Optionally, there can be a substantially planar surface on the front side for supporting material which allows for use as a writing block. A means for tracking the records comprises having each document and folder possessing markings similar to the marking on the box.

In the preferred embodiment, the portable medical record holder has an alphanumeric system which matches all of the records and folders with the holders box. This coding system has an alphanumeric code placed on the top of each chart folder and has the same code placed on the top face of the box holder.

In addition, the medical record holder has a handle upon which a hook is attached. The hook has two ends, with one end attached to the handle of the medical record holder. The other end of the hook can be used for attaching the medical record holder to the patient's bed rail. Also, this medical record holder has a plurality of bumpers designed to guard the box from damage if the box falls or drops. These bumpers would guard the edges, faces and sides of the medical record holder.

Furthermore, the medical record holder can have a door in the bottom surface of the box, with the bottom door opening into a storage compartment within the box. This door can be fastened shut using various fastening means. Also, the box can have a transparent envelope pouch on the front surface of the box, with the pouch able to be fastened to the front surface of the box and the pouch having a means for tightly sealing the contents of the pouch such as a patient identity card.

BRIEF DESCRIPTION OF THE DRAWINGS

Other objects and features of the present invention will become apparent from the following detailed description considered in connection with the accompanying drawings which disclose several embodiments of the present invention. It should be understood, however, that the drawings are designed for the purpose of illustration only and not as a definition of the limits of the invention.

In the drawings, wherein similar reference characters denote similar elements throughout the several views.

DETAILED DESCRIPTION OF PREFERRED EMBODIMENTS

Figure 1:
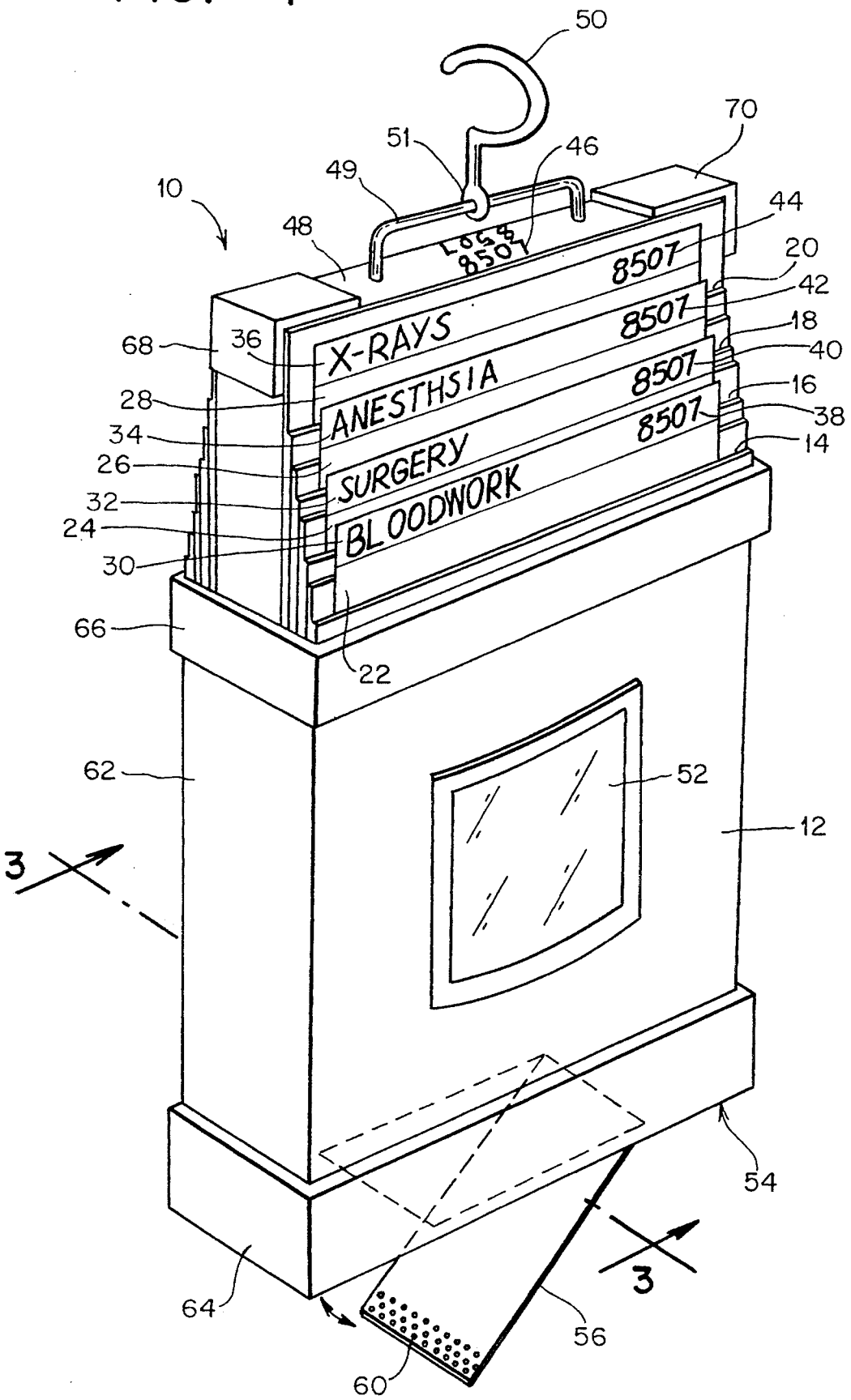
FIG. 1 is a front perspective view of an embodiment of the medical record holder box of the invention.

Turning now in detail to the drawings, FIG. 1 is a perspective view of the portable patient medical record holder 10 of the invention. Medical record holder 10 has a front side 12 wherein the front side has four slots 14, 16, 18, and 20. Inside these slots fit folders 22, 24, 26, and 28. In the top portion of these folders are identifying labels 30, 32, 34, 36 which signify the document category for each folder. In addition, these folders have numbers 38, 40, 42, and 44 which correspond to the number 46 on the top surface 48. This top surface has a carrying handle 49, and attached thereto is a hook 50 for connecting the medical record holder to the end of a patient's bed. Attachment means 51 permits sliding and rotary movement of hook 50 on handle 49. On the lower half of the front side 12 is a pouch 52. The pouch 52 can hold information cards such as the patient's health security card.

The bottom surface 54 has a door 56 which opens to a storage compartment 58. This door 56 can be fixed shut using various fastening means 60, such as VELCRO, which is the trademark that is for hook and loop types of fasteners. The left side 62 of the medical record holder shows a bottom bumper 64 and a middle bumper 66, both of which extend completely around the medical record holder. Bumper 68 covers the left shoulder and bumper 70 covers the right shoulder. The bumpers 64, 66, 68 and 70 shield the medical record holder's edges, sides, and faces from damage if the medical record holder falls to the floor or ground.

Figure 2:
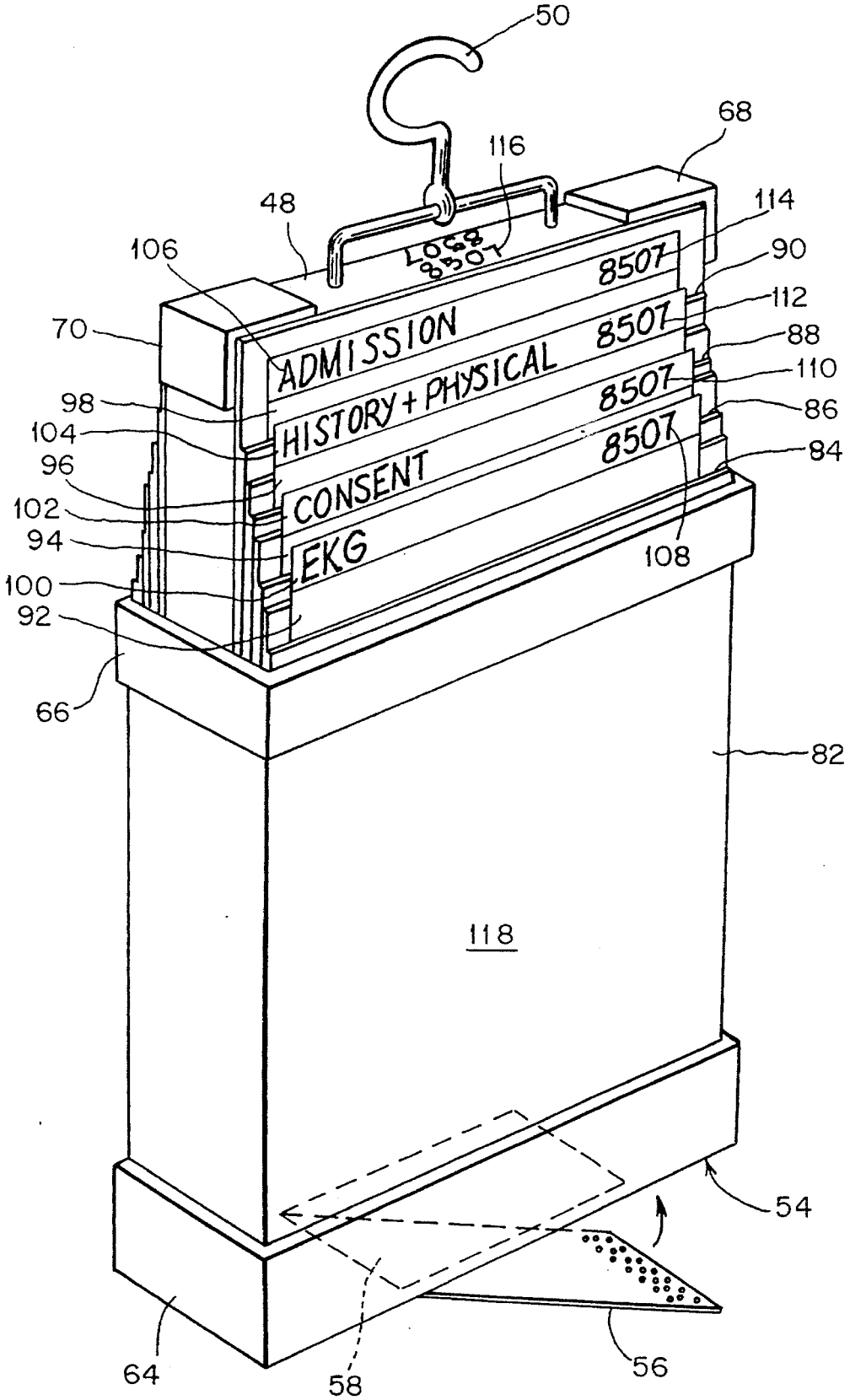
FIG. 2 is a back perspective view of the embodiment of FIG. 1.

FIG. 2 shows the perspective view of the back side 82 of the portable patient medical record holder 10. This back side has four slots 84, 86, 88, and 90. Inside these slots fit folders 92, 94, 96, and 98. In the top portion of these folders are identifying labels 100, 102, 104, 106 which signify the field of medicine for each chart. In addition, these charts have numbers 108, 110, 112, and 114 which correspond to the number 116 on the top face 48. On the lower half of the back side 82 is the writing tablet 118. This writing tablet is designed to support any material such as paper for graphic inscription thereon.

Figure 3:
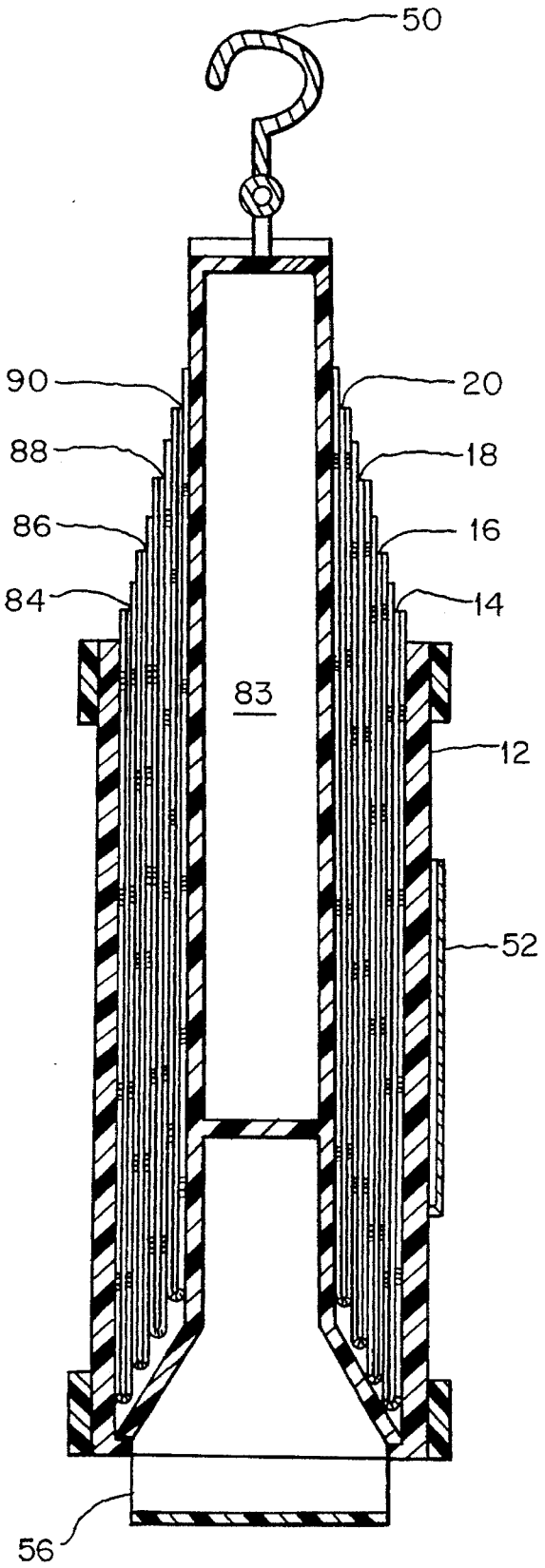
FIG. 3 a sectional view, taken along the lines 3—3, of FIG. 1.

FIG. 3 shows a sectional view, taken along the lines 3—3, of FIG. 1. On the front side 12, it can be seen that pockets 70, 72, 74 and 76 extending from slots 14, 16, 18 and 20, respectively, down into the hollow interior 83 of the holder 10. These pockets are designed to hold the folders securely within the medical record holder. On the back side 118, it can be seen that pockets 130, 132, 134 and 136 extend from slots 84, 86, 88 and 90, respectively, down into the hollow interior 83 of the medical record holder.

While a single embodiment of the present invention has been shown and described, it is to be understood that many changes and modifications may be made thereunto without departing from the spirit and scope of the invention as defined in the appended claims.

What is claimed is:

1. A portable patient medical record holder having a color coded system for holding folders, said medical record holder comprising:

an elongated box with a front side having a lateral distance and a back side having a lateral distance, each of said sides having a plurality of parallel spaced slots extending substantially across the lateral distance of said front and back sides;

a plurality of pockets extending into said elongated box from said slots, wherein said pockets support folders within said slots; and means for tracking housed documents, wherein each of said documents, folders and medical record holder have the same markings.

2. The portable patient medical record holder as claimed in claim 1, wherein said means for tracking said files is an alphanumeric system.

3. The portable patient medical record holder as claimed in claim 1, wherein said top side of said box has a hook attached thereto for releasably coupling said box to an end of a patient's bed.

4. The portable patient medical record holder as claimed in claim 1, further comprising a plurality of bumpers disposed on said front side and said back side of said box and on corners, said bumpers protecting said box from damage.

5. The portable patient medical record holder as claimed in claim 1, wherein said box has a storage compartment therein, and said box has a bottom face having a hinged door which can be fixed in a closed position and an open position, said door leading to the storage compartment within said box.

6. The portable patient medical record holder as claimed in claim 1, further comprising a pouch for storage attached to a side of said box.

7. The portable patient medical record holder as claimed in claim 1, further comprising a substantially planar surface on said front side for supporting material which allows for it to be used as a writing block.

8. The portable patient medical record holder as claimed in claim 1, wherein said top side of said box has a handle for carrying said holder and for providing a mount for a hook.

* * * * *